US011830452B2

(12) United States Patent
Liu et al.

(10) Patent No.: US 11,830,452 B2
(45) Date of Patent: Nov. 28, 2023

(54) DISPLAY PANEL, DISPLAY PANEL DRIVING METHOD, AND ELECTRONIC DEVICE

(71) Applicant: TCL CHINA STAR OPTOELECTRONICS TECHNOLOGY CO., LTD., Guangdong (CN)

(72) Inventors: Jinfeng Liu, Guangdong (CN); Fengcheng Xu, Guangdong (CN)

(73) Assignee: TCL CHINA STAR OPTOELECTRONICS TECHNOLOGYCO., LTD., Hubei (CN)

( * ) Notice: Subject to any disclaimer, the term of this patent is extended or adjusted under 35 U.S.C. 154(b) by 12 days.

(21) Appl. No.: 17/600,209

(22) PCT Filed: Sep. 9, 2021

(86) PCT No.: PCT/CN2021/117360
§ 371 (c)(1),
(2) Date: Sep. 30, 2021

(87) PCT Pub. No.: WO2023/024169
PCT Pub. Date: Mar. 2, 2023

(65) Prior Publication Data

US 2023/0061612 A1 Mar. 2, 2023

(30) Foreign Application Priority Data

Aug. 24, 2021 (CN) ..... 202110972025.8

(51) Int. Cl.
*G09G 3/36* (2006.01)

(52) U.S. Cl.
CPC ..... *G09G 3/3648* (2013.01); *G09G 3/3677* (2013.01); *G09G 3/3688* (2013.01);
(Continued)

(58) Field of Classification Search
CPC ..... G09G 3/3233; G09G 2300/0819; G09G 2300/0842
See application file for complete search history.

(56) References Cited

U.S. PATENT DOCUMENTS 10,964,262 B1 * 3/2021 Lin ..... G09G 3/2022
2005/0200293 A1 * 9/2005 Naugler ..... G09G 3/3233 257/E27.129

(Continued)

FOREIGN PATENT DOCUMENTS

CN 106205540 A 12/2016
CN 109473055 A 3/2019

(Continued)

OTHER PUBLICATIONS

International Search Report in International application No. PCT/CN2021/117360, dated May 19, 2022.

(Continued)

*Primary Examiner* — Van N Chow
(74) *Attorney, Agent, or Firm* — PV IP PC; Zhigang Ma; Wei Te Chung

(57) ABSTRACT

A display panel, a display panel driving method, and an electronic device are provided. The electronic device includes a display panel. The display panel includes a display region, source drive circuits, and a gate drive circuit. The display region includes a plurality of sub-pixels. By reducing the charging time of the sub-pixels close to the gate drive circuit and increasing the charging time of the sub-pixels away from the gate drive circuit, the voltage difference between the sub-pixels in different regions is reduced, thereby solving the problem of uneven brightness of the display panel.

19 Claims, 6 Drawing Sheets

(52) U.S. Cl.
CPC ..... *G09G 2310/0286* (2013.01); *G09G 2310/0291* (2013.01); *G09G 2310/08* (2013.01); *G09G 2320/0233* (2013.01)

(56) References Cited

U.S. PATENT DOCUMENTS

| | | | | |
|---|---|---|---|---|
| 2019/0035349 | A1 | 1/2019 | Jeong | |
| 2022/0180815 | A1* | 6/2022 | Kim | G09G 3/3275 |
| 2023/0005423 | A1* | 1/2023 | Lu | G09G 3/3233 |
| 2023/0061612 | A1* | 3/2023 | Liu | G09G 3/3688 |

FOREIGN PATENT DOCUMENTS

| | | | |
|---|---|---|---|
| CN | 109473075 | A | 3/2019 |
| CN | 109559703 | A | 4/2019 |
| CN | 110322856 | A | 10/2019 |

OTHER PUBLICATIONS

Written Opinion of the International Search Authority in International application No. PCT/CN2021/117360, dated May 19, 2022.

* cited by examiner

DISPLAY PANEL, DISPLAY PANEL DRIVING METHOD, AND ELECTRONIC DEVICE

FIELD OF INVENTION

The present disclosure relates to the field of display technology, and in particular, to a display panel, a display panel driving method, and an electronic device.

BACKGROUND OF INVENTION

In recent years, with the development of electronic technology, mobile electronic display devices such as mobile phones and tablets have become indispensable social media and information storage carriers in people's daily lives.

Technical Problem

For conventional large-size electronic devices, due to the large transverse width of the display panel, the capacitance-resistance delay of the scanning line will lead to a large difference between the voltage of the scan signal at the end close to the gate drive circuit to the voltage of the scan signal at the end far away from the gate drive circuit. In the process of charging the sub-pixels, the charging duration of the sub-pixels close to the gate drive circuit is longer than that of the sub-pixels far away from the gate drive circuit. Consequently, after the charging is completed, the voltage of the sub-pixels close to the gate drive circuit is different from the voltage of the sub-pixels far away from the gate drive circuit, resulting in uneven brightness of the display panel in the transverse direction.

To sum up, conventional display panels have the problem of uneven brightness due to the capacitance-resistance delay of the scanning line. Therefore, it is necessary to provide a display panel, a display panel driving method, and an electronic device to solve this defect.

SUMMARY OF INVENTION

Technical Solution

Embodiments of the present disclosure provide a display panel, a display panel driving method, and an electronic device, to solve the problem of uneven brightness of conventional display panels due to the capacitance-resistance delay of the scanning line.

An embodiment of the present disclosure provides a display panel, including:

a display region, including sub-pixels distributed in a plurality of rows and a plurality of columns;

a plurality of source drive circuits, connected to the display region, wherein each of the source drive circuits is configured to output a data signal to a corresponding plurality of columns of sub-pixels; and a gate drive circuit, connected to the display region, and configured to output a scan signal to a corresponding plurality of rows of sub-pixels, wherein the source drive circuits each include a time control unit, the time control unit is configured to control an output duration of the data signal outputted by the source drive circuit to the sub-pixels within one frame time, and a distance between the sub-pixel and the gate drive circuit is positively correlated to the output duration.

According to an embodiment of the present disclosure, the time control unit includes:

a storage register, configured to store a set value of the output duration;

a clock generator, connected to the storage register, wherein the clock generator is configured to generate a clock signal with a corresponding pulse width according to the set value of the output duration; and a shift register, connected to the clock generator, wherein the shift register is configured to output the data signal with a corresponding pulse width according to the clock signal.

According to an embodiment of the present disclosure, the time control unit further includes:

a detection module, configured to acquire on durations of switching thin film transistors corresponding to a plurality of columns of sub-pixels connected to the same source drive circuit within one frame time, and obtain an average on duration according to the on durations of the switching thin film transistors; and a level setting module, respectively connected to the detection module and the storage register, wherein the level setting module is configured to set and select a required output adjustment level according to the number of the source drive circuits and the average on duration.

According to an embodiment of the present disclosure, the obtaining the average on duration according to the on durations of the switching thin film transistors by the detection module further includes:

acquiring a maximum on duration and a minimum on duration among the on durations; and obtaining the average on duration of the switching thin film transistors corresponding to the plurality of columns of sub-pixels within one frame time according to the maximum on duration and the minimum on duration.

According to an embodiment of the present disclosure, the setting and selecting the required output adjustment level according to the number of the source drive circuits and the average on duration by the level setting module further includes:

acquiring an effective charging duration required for the sub-pixels to reach a target voltage;

obtaining the output duration according to an initial output duration of outputting of the data signal to the sub-pixels by the source drive circuit within one frame time, the effective charging duration, and the average on duration; and setting a plurality of output adjustment levels and the output duration corresponding to each of the output adjustment levels according to the number of the source drive circuits and the average on duration corresponding to each of the source drive circuits.

According to an embodiment of the present disclosure, the obtaining the output duration according to an initial output duration of outputting of the data signal to the sub-pixels by the source drive circuit within one frame time, the effective charging duration, and the average on duration further includes:

obtaining an output compensation duration according to the average on duration and the effective charging duration; and obtaining the output duration according to the initial output duration and the output compensation duration, wherein the output compensation duration is a difference between the average on duration and the effective charging duration, and the output duration is a difference between the initial output duration and the output compensation duration.

According to an embodiment of the present disclosure, the output durations of the data signals received by the plurality of columns of sub-pixels connected to the same source drive circuit are equal.

According to an embodiment of the present disclosure, the source drive circuit further includes:

an input register, configured to receive and store display data;

a line latch, respectively connected to the input register and the time control unit, wherein the line latch is configured to latch the display data in the input register;

a digital-to-analog converter, connected to the time control unit, wherein the digital-to-analog converter is configured to convert a digital signal into an analog signal; and an output buffer circuit, connected to the digital-to-analog converter, and configured to output the data signal converted by the digital-to-analog converter to the sub-pixels.

An embodiment of the present disclosure provides an electronic device, including a display panel, wherein the display panel includes:

a display region, including sub-pixels distributed in a plurality of rows and a plurality of columns;

a plurality of source drive circuits, connected to the display region, wherein each of the source drive circuits is configured to output a data signal to a corresponding plurality of columns of sub-pixels; and a gate drive circuit, connected to the display region, and configured to output a scan signal to a corresponding plurality of rows of sub-pixels, wherein the source drive circuits each include a time control unit, the time control unit is configured to control an output duration of the data signal outputted by the source drive circuit to the sub-pixels within one frame time, and a distance between the sub-pixel and the gate drive circuit is positively correlated to the output duration.

According to an embodiment of the present disclosure, the time control unit includes:

a storage register, configured to store a set value of the output duration;

a clock generator, connected to the storage register, wherein the clock generator is configured to generate a clock signal with a corresponding pulse width according to the set value of the output duration; and a shift register, connected to the clock generator, wherein the shift register is configured to output the data signal with a corresponding pulse width according to the clock signal.

According to an embodiment of the present disclosure, the time control unit further includes:

a detection module, configured to acquire on durations of switching thin film transistors corresponding to a plurality of columns of sub-pixels connected to the same source drive circuit within one frame time, and obtain an average on duration according to the on durations of the switching thin film transistors; and a level setting module, respectively connected to the detection module and the storage register, wherein the level setting module is configured to set and select a required output adjustment level according to the number of the source drive circuits and the average on duration.

According to an embodiment of the present disclosure, the obtaining the average on duration according to the on durations of the switching thin film transistors by the detection module further includes:

acquiring a maximum on duration and a minimum on duration among the on durations; and obtaining the average on duration of the switching thin film transistors corresponding to the plurality of columns of sub-pixels connected to the same source drive circuit within one frame time according to the maximum on duration and the minimum on duration.

According to an embodiment of the present disclosure, the setting and selecting the required output adjustment level according to the number of the source drive circuits and the average on duration by the level setting module further includes:

acquiring an effective charging duration required for the sub-pixels to reach a target voltage;

obtaining the output duration according to an initial output duration of outputting of the data signal to the sub-pixels by the source drive circuit within one frame time, the effective charging duration, and the average on duration; and setting a plurality of output adjustment levels and the output duration corresponding to each of the output adjustment levels according to the number of the source drive circuits and the average on duration corresponding to each of the source drive circuits.

According to an embodiment of the present disclosure, the obtaining the output duration according to an initial output duration of outputting of the data signal to the sub-pixels by the source drive circuit within one frame time, the effective charging duration, and the average on duration further includes:

obtaining an output compensation duration according to the average on duration and the effective charging duration; and obtaining the output duration according to the initial output duration and the output compensation duration, wherein the output compensation duration is a difference between the average on duration and the effective charging duration, and the output duration is a difference between the initial output duration and the output compensation duration.

According to an embodiment of the present disclosure, the output durations of the data signals received by the plurality of columns of sub-pixels connected to the same source drive circuit are equal.

An embodiment of the present disclosure further provides a display panel driving method, including:

acquiring on durations of switching thin film transistors corresponding to a plurality of columns of sub-pixels connected to the same source drive circuit within one frame time;

adjusting an output duration of a data signal outputted by the source drive circuit to the sub-pixels within one frame time according to the on durations; and outputting the adjusted data signal to the sub-pixels, wherein a distance between the sub-pixel and a gate drive circuit is positively correlated to the output duration, and a distance between the sub-pixel and the gate drive circuit is negatively correlated to the on duration.

According to an embodiment of the present disclosure, the step of adjusting an output duration of a data signal outputted by the source drive circuit to the sub-pixels within one frame time according to the on durations includes:

acquiring a maximum on duration and a minimum on duration among the on durations;

obtaining the average on duration of the switching thin film transistors corresponding to the plurality of columns of sub-pixels within one frame time according to the maximum on duration and the minimum on duration; and obtaining the output duration according to an initial output duration of outputting of the data signal to the sub-pixels by the source drive circuit within one frame time, the effective charging duration, and the average on duration.

According to an embodiment of the present disclosure, the step of obtaining the output duration according to an initial output duration of outputting of the data signal to the sub-pixels by the source drive circuit within one frame time, the effective charging duration, and the average on duration includes:

obtaining an output compensation duration according to the average on duration and the effective charging duration; and obtaining the output duration according to the initial output duration and the output compensation duration, wherein the output compensation duration is a difference between the average on duration and the effective charging duration, and the output duration is a difference between the initial output duration and the output compensation duration.

According to an embodiment of the present disclosure, the display panel driving method further includes:

setting a plurality of output adjustment levels and the output duration corresponding to each of the output adjustment levels according to the number of the source drive circuits and the average on duration corresponding to each of the source drive circuits.

According to an embodiment of the present disclosure, the output durations of the data signals received by the plurality of columns of sub-pixels connected to the same source drive circuit are equal.

Beneficial Effects

Beneficial effects of the embodiments of the present disclosure are described as follows. The embodiments of the present disclosure provide a display panel, a display panel driving method, and an electronic device. The electronic device includes the display panel. The display panel driving method is used for driving the display panel. The display panel includes a display region, a gate drive circuit, and a plurality of source drive circuits. The display region includes sub-pixels distributed in a plurality of rows and a plurality of columns. The gate drive circuit is connected to at least one end of the display region, and the source drive circuits are connected to the display region. Each of the source drive circuits is configured to output a data signal to a corresponding plurality of columns of sub-pixels. The source drive circuits each include a time control unit. The time control unit is configured to control an output duration of the data signal outputted by the source drive circuit to the sub-pixels within one frame time. A distance between the sub-pixel and the gate drive circuit is positively correlated to the output duration. This can reduce the charging time of the sub-pixels close to the gate drive circuit and increase the charging time of the sub-pixels away from the gate drive circuit, so as to reduce the voltage difference between the sub-pixels close to the gate drive circuit and the sub-pixels away from the gate drive circuit, thereby solving the problem of uneven brightness of the display panel in the transverse direction.

BRIEF DESCRIPTION OF DRAWINGS

To describe the technical solutions in the embodiments or the existing technology more clearly, the following briefly describes the accompanying drawings required for describing the embodiments or the existing technology. Apparently, the accompanying drawings in the following description show merely some embodiments of the present disclosure, and a person of ordinary skill in the art may derive other drawings according to these accompanying drawings without creative efforts.

DETAILED DESCRIPTION OF PREFERRED EMBODIMENTS

Figure 1:
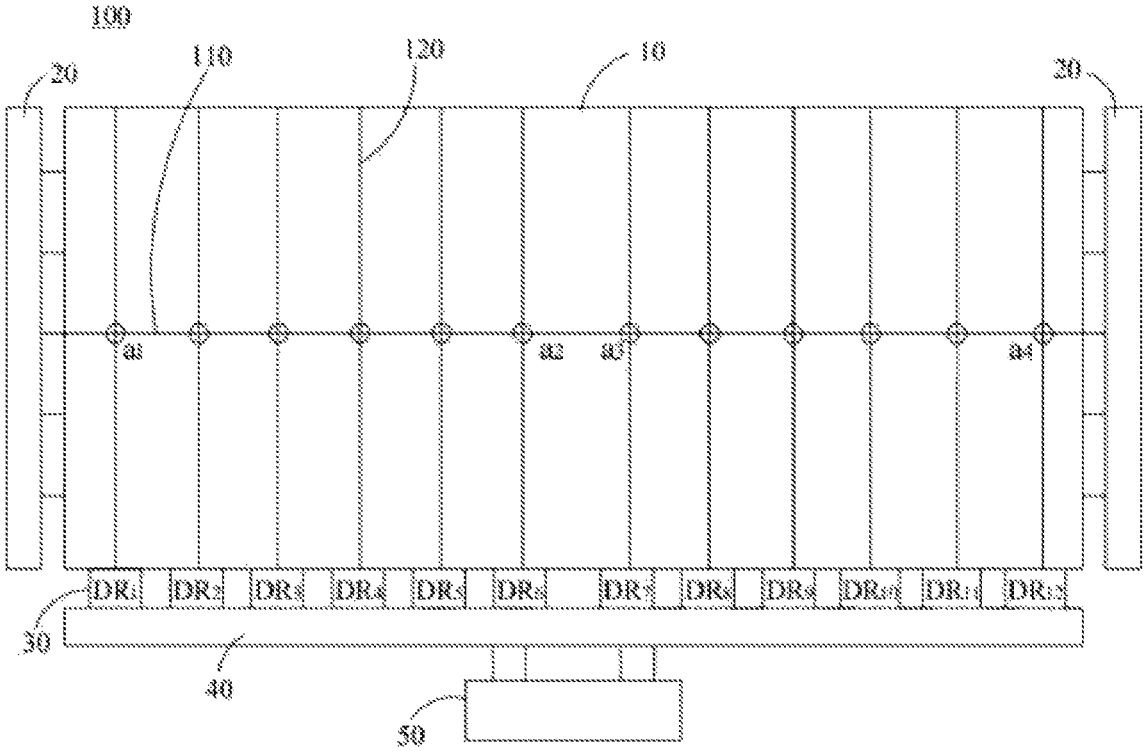
FIG. 1 is a schematic structural diagram of a display panel according to an embodiment of the present disclosure.

The following description of various embodiments is provided to exemplify the specific embodiments for implementation of the present disclosure with reference to accompanying drawings. The directional terms mentioned in the present disclosure, such as "above", "below", "front", "back", "left", "right", "in", "out", and "side", merely refer to the directions in the accompanying drawings. Therefore, the used direction terms are intended to describe and understand the present disclosure, but are not intended to limit the present disclosure. In the figures, structurally similar units are denoted by the same reference numerals.

The present disclosure is further described below with reference to the accompanying drawings and specific embodiments.

The embodiments of the present disclosure provide a display panel, a display panel driving method, and an electronic device. The electronic device includes the display panel. The display panel driving method is used for driving the display panel.

The electronic device may be a vehicle-mounted display terminal, such as a vehicle-mounted display or a vehicle data recorder. The electronic device may also be a mobile terminal, such as a smart phone, a tablet computer, or a notebook computer, or a wearable terminal, such as a smart watch, a smart band, smart glasses, or an augmented reality (AR) device. The electronic device may also be a fixed terminal, such as a desktop computer or a television. The electronic device may also be a vehicle-mounted display terminal, such as a vehicle-mounted display or a vehicle data recorder.

FIG. 1 is a schematic structural diagram of a display panel according to an embodiment of the present disclosure. As shown in FIG. 1, the display panel 100 includes a display region 10, a gate drive circuit 20, and a plurality of source drive circuits 30.

The display region 10 includes a plurality of sub-pixels distributed in a plurality of rows and a plurality of columns, a plurality of scanning lines 110 extending along a first direction x and spaced apart from each other in a second direction y, and a plurality of data lines 120 extending along the second direction y and spaced apart from each other in the first direction x. Each sub-pixel has a corresponding switching thin film transistor. The source drive circuit 30 is connected to the data lines 120, and outputs a data signal to the sub-pixels through the data lines 120. The gate drive circuit 20 is connected to the scanning lines 110 to control on and off of the switching thin film transistors corresponding to the sub-pixels.

In an embodiment of the present disclosure, each source drive circuit 30 is a source driver chip. The source driver chip may be bound on a flexible circuit board. The flexible circuit board is connected to the display region 10 and a control board 40. The control board 40 is connected to a timing controller 50.

In practical applications, the source driver chip is not limited to being bound on the flexible circuit board, and the source driver chip may also be directly bound on the display region 10 or bound on a printed circuit board.

In an embodiment of the present disclosure, the display panel 100 includes two gate drive circuits 20. The two gate drive circuits 20 are respectively arranged at opposite ends of the display region 10. The two gate drive circuits 20 simultaneously output scan signals to the display region 10, so as to reduce the delay of the scan signals received by and the voltage difference between the sub-pixels close to the gate drive circuit 20 and the sub-pixels far away from the gate drive circuit 20, thereby increasing the refresh rate of the display panel and alleviating the problem of uneven display brightness of the display panel 100.

In practical applications, the display panel 100 may also have only one gate drive circuit 20, and the gate drive circuit 20 may be arranged on either a left side or a right side of the display region 10.

In an embodiment of the present disclosure, the display panel 100 is a liquid crystal display panel adopting a dual-gate architecture. Drains of the switching thin film transistors corresponding to two neighboring columns of sub-pixels are connected to the same data line 120. Two neighboring scanning lines 110 are connected to gates of the switching thin film transistors corresponding to the sub-pixels in the same row. Sources of the switching thin film transistors are connected to sub-pixel electrodes of the sub-pixels. On and off of the switching thin film transistors corresponding to the sub-pixels are controlled in a time-sharing manner through the scanning lines 110. Two neighboring columns of sub-pixels can be driven in a time-sharing manner through one data line 120. Therefore, the area occupied by the source drive circuits 30 can be reduced or the number of source drive circuits 30 can be reduced.

Compared with a conventional liquid crystal display panel adopting a single-gate architecture, the liquid crystal display panel using the dual-gate architecture has a shorter charging time for each row of sub-pixels. Due to the capacitance-resistance delay of the scanning lines 110, the voltage of the sub-pixels close to the gate drive circuit 20 is different from the voltage of the sub-pixels far away from the gate drive circuit 20, which is likely to cause uneven brightness of the display panel 100.

Figure 2:
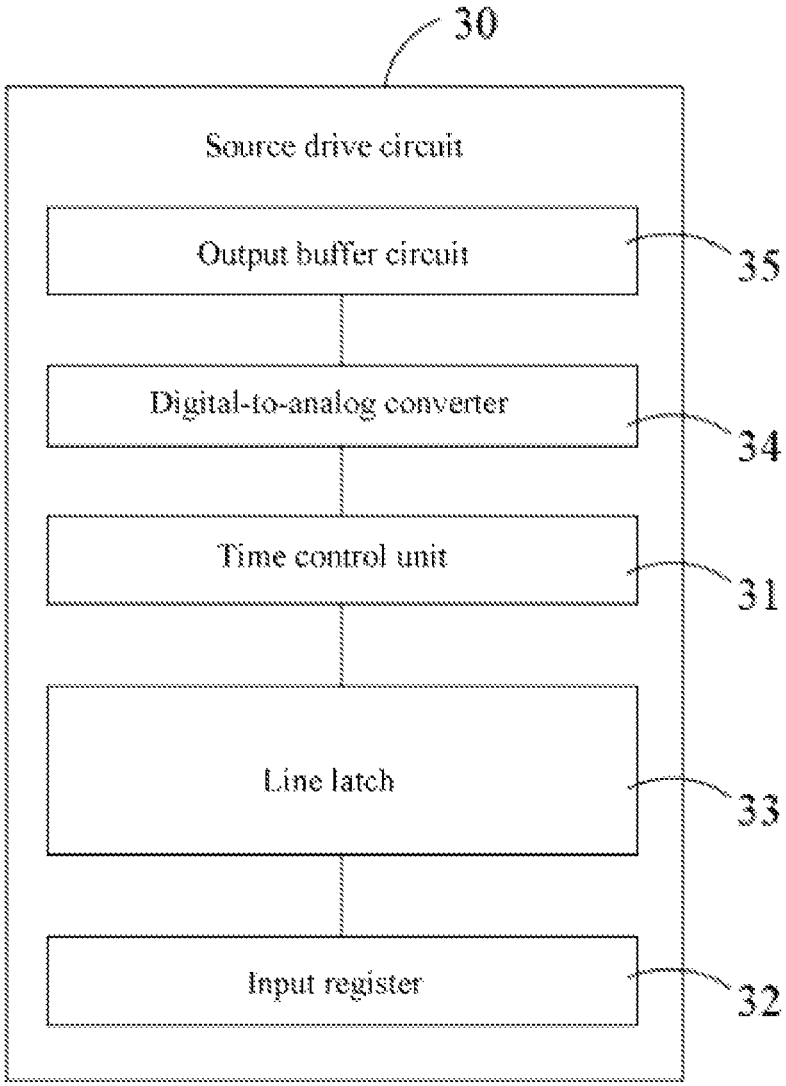
FIG. 2 is a schematic structural diagram of a source drive circuit according to an embodiment of the present disclosure.

FIG. 2 is a schematic structural diagram of a source drive circuit according to an embodiment of the present disclosure. As shown in FIG. 2, in an embodiment of the present disclosure, the source drive circuit 30 further includes a time control unit 31. The time control unit 31 is configured to control an output duration of the data signal outputted by the source drive circuit 30 to the sub-pixels within one frame time. A distance between the sub-pixel and the gate drive circuit is positively correlated to the output duration. The distance between the sub-pixel and the gate drive circuit is negatively correlated to an on duration of the switching thin film transistor corresponding to the sub-pixel within one frame time. This can reduce the charging time of the sub-pixels close to the gate drive circuit 20 and increase the charging time of the sub-pixels far away from the gate drive circuit 20, so as to reduce the voltage difference between the sub-pixels close to the gate drive circuit 20 and the sub-pixels far away from the gate drive circuit 20, thereby solving the problem of uneven brightness of the display panel 100 and improving the display uniformity of the display panel 100.

In practical applications, the type of the display panel 100 is not limited to the above-mentioned liquid crystal display panel adopting the double-gate architecture, and the display panel 100 may also be a liquid crystal display panel adopting a conventional structure or a liquid crystal display panel adopting a tri-gate architecture.

Further, the source drive circuit 30 further includes an input register 32, a line latch 33, a digital-to-analog converter 34, and an output buffer circuit 35.

The input register 32 is configured to receive and store display data outputted by the timing controller 50 to the source drive circuit 30. An input end of the line latch 33 is connected to an output end of the input register 32, and the line latch 33 is configured to latch the display data in the input register 32.

An output end of the line latch 33 is connected to an input end of the time control unit 31 to transmit the display data to the time control unit.

An input end of the digital-to-analog converter 34 is connected to an output end of the time control unit 31 to receive the data signal adjusted by the time control unit 31, and the digital-to-analog converter 34 is configured to convert the data signal outputted by the time control unit 31 into an analog signal.

An output end of the digital-to-analog converter 34 is connected to an input end of the output buffer circuit 35, and the output buffer circuit 35 is configured to output the data signal converted by the digital-to-analog converter 34 to each sub-pixel.

Figure 3:
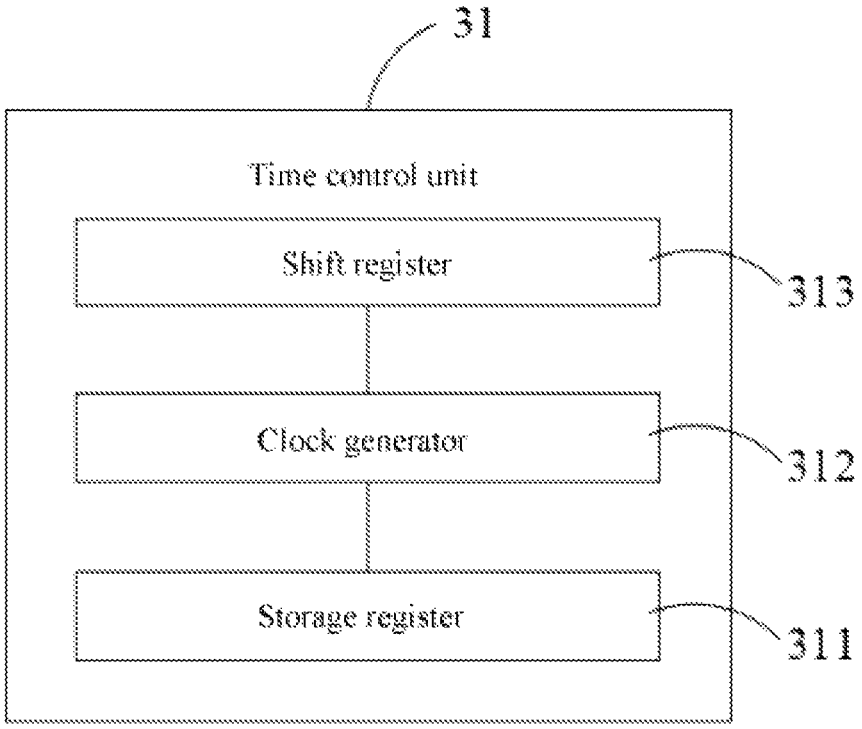
FIG. 3 is a schematic structural diagram of a first time control unit according to an embodiment of the present disclosure.

Further, FIG. 3 is a schematic structural diagram of a first time control unit according to an embodiment of the present disclosure. As shown in FIG. 3, the time control unit 31 includes a storage register 311, a clock generator 312, and a shift register 313.

The storage register 311 is configured to store a set value of the output duration of the data signal outputted by the source drive circuit 30.

An output end of the clock generator 312 is connected to an input end of the storage register 311, and the clock generator 312 is configured to generate a clock signal with a corresponding pulse width according to the set value of the output duration.

An input end of the shift register 313 is connected to the line latch 33 to receive the data signal outputted from the line latch 33 to the shift register 313, and the data signal has an initial pulse width at this moment.

The input end of the shift register 313 is further connected to the output end of the clock generator 312, and the shift register 313 is configured to adjust the initial pulse width of the data signal according to the clock signal, and output a data signal having a pulse width corresponding to that of the clock signal.

Figure 4:
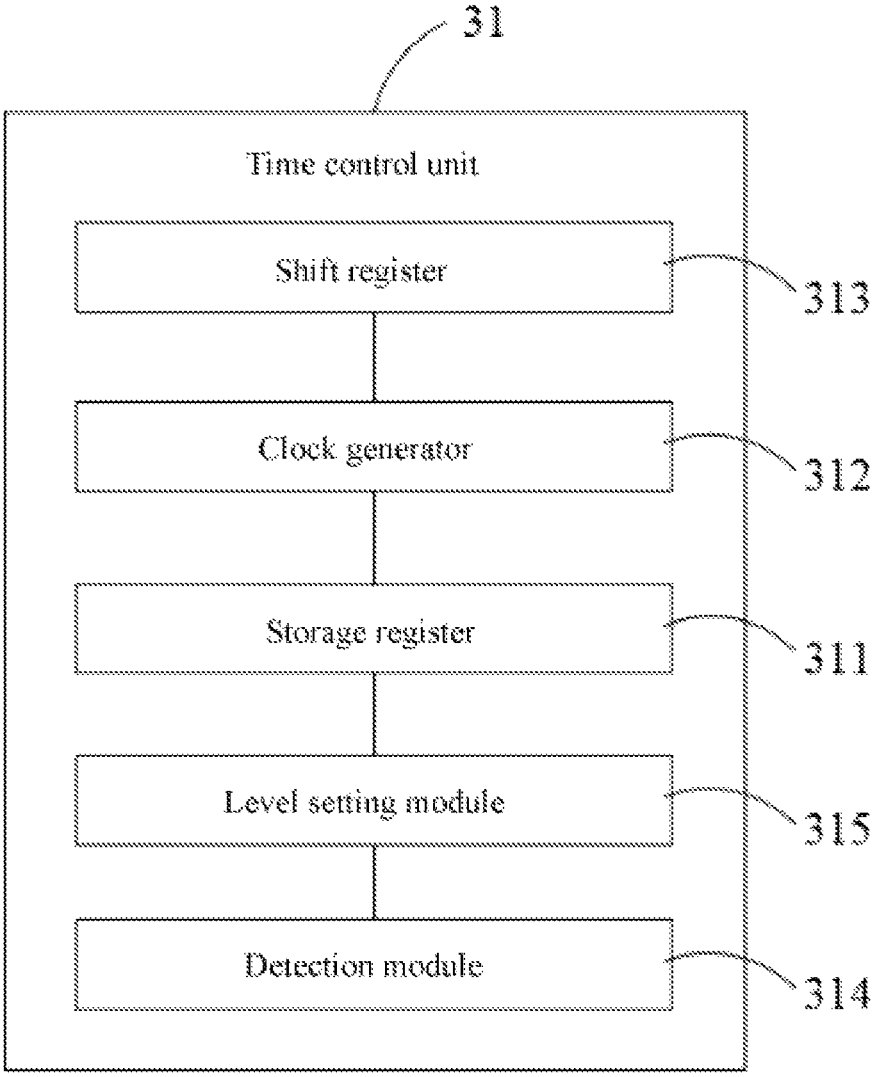
FIG. 4 is a schematic structural diagram of a second time control unit according to an embodiment of the present disclosure.

Further, FIG. 4 is a schematic structural diagram of a second time control unit according to an embodiment of the present disclosure. As shown in FIG. 4, the time control unit 31 further includes a detection module 314. The detection module 314 is configured to acquire on durations of switching thin film transistors corresponding to a plurality of columns of sub-pixels connected to the same source drive circuit within one frame time, and obtain an average on duration according to the on durations of the switching thin film transistors.

In an embodiment, the obtaining the average on duration according to the on durations of the switching thin film transistors by the detection module 314 further includes:

acquiring a maximum on duration and a minimum on duration among the on durations; and obtaining the average on duration of the switching thin film transistors corresponding to the plurality of columns of sub-pixels connected to the same source drive circuit 30 within one frame time according to the maximum on duration and the minimum on duration, wherein the average on duration is an average of the maximum on duration and the minimum on duration.

In a practical application, for example, the on durations of the switching thin film transistors corresponding to the first column and the last column of sub-pixels in the plurality of columns of sub-pixels connected to the same source drive circuit 30 are acquired, and the on durations of the switching thin film transistors corresponding to the first column and the last column of sub-pixels are used as the maximum on duration and the minimum on duration.

In an embodiment, the average on duration may alternatively be obtained by acquiring the on durations of the thin film transistors corresponding to the plurality of columns of sub-pixels connected to the same source drive circuit 30 through the detection module 314, calculating a total on duration by summing up the on durations of the thin film transistors corresponding to the columns of sub-pixels, and dividing the total on duration by the number of columns of sub-pixels connected to the same source drive circuit.

In an embodiment, the time control power supply 31 may not include the detection module 314. Instead, an external detection device is used to directly detect and acquire the on durations of the switching thin film transistors corresponding to the plurality of columns of sub-pixels connected to the same source drive circuit within one frame time, and obtain the average on duration according to the on durations of the switching thin film transistors. Then according to the average on duration corresponding to the source drive circuit 30, different output duration values are inputted to obtain an output duration value that can achieves the optimal display effect, and the output duration value is stored in the storage register 311 as the set value of the output duration. The set value of the output duration is a fixed value, which will not automatically change during daily use, but the set value of the output duration can be adjusted as required using software built in the electronic device or using an external device.

Further, the time control unit further includes a level setting module 315. The level setting module 315 is configured to set and select an output adjustment level according to the number of the source drive circuits and the average on duration.

An input end of the level setting module 315 is connected to an output end of the detection module 314. The process of setting and selecting the output adjustment level according to the number of the source drive circuits and the average on duration by the level setting module 315 further includes: acquiring an effective charging duration required for the sub-pixels to reach a target voltage; obtaining the output duration according to an initial output duration of outputting of the data signal to the sub-pixels by the source drive circuit 30 within one frame time, the effective charging duration, and the average on duration; and setting a plurality of output adjustment levels and the output duration corresponding to each of the output adjustment levels according to the number of the source drive circuits 30 and the average on duration corresponding to each of the source drive circuits 30.

Further, the process of obtaining the output duration according to an initial output duration of outputting of the data signal to the sub-pixels by the source drive circuit within one frame time, the effective charging duration, and the average on duration further includes:

obtaining an output compensation duration according to the average on duration and the effective charging duration; and obtaining the output duration according to the initial output duration and the output compensation duration. It should be noted that the initial output duration is a pulse width of the data signal before the adjustment by the time control unit 31.

In this embodiment, the output compensation duration is a difference between the average on duration and the effective charging duration, and the output duration is a difference between the initial output duration and the output compensation duration, which may be expressed by the following formula: $T_1=T_0-(T_2-T_3)$. wherein $T_0$ is the initial output duration, $T_1$ is the output duration, $T_2$ is the average on duration, and $T_3$ is the effective charging duration.

In an embodiment, as shown in FIG. 1, the display panel includes 12 source drive circuits 30, which are sequentially numbered $DR_1$, $DR_2$, . . . , $DR_{12}$. $DR_1$ and $DR_{12}$ are the closest to the gate drive circuit 20. Switching thin film transistors corresponding to sub-pixels connected to $DR_1$ and $DR_{12}$ have the largest average on duration. $DR_6$ and $DR_7$ are the farthest to the gate drive circuit 20. Switching thin film transistors corresponding to sub-pixels connected to $DR_6$ and $DR_7$ have the smallest average on duration. From $DR_1$ to $DR_6$ and from $DR_{12}$ to $DR_7$, the average on duration of the switching thin film transistors gradually decreases.

As for the output adjustment levels, 6 levels of output durations are set. The same level is set for $DR_1$ and $DR_{12}$, the same level is set for $DR_2$ and $DR_{11}$, and by analogy, the same level is set for $DR_6$ and $DR_7$. From $DR_1$ to $DR_6$ and from $DR_{12}$ to $DR_7$, the set value of the output duration gradually increases. In practical applications, it may not be necessary to set a separate level for each source drive circuit 30, and two or more neighboring source drive circuits 30 may share a same level.

Figure 5:
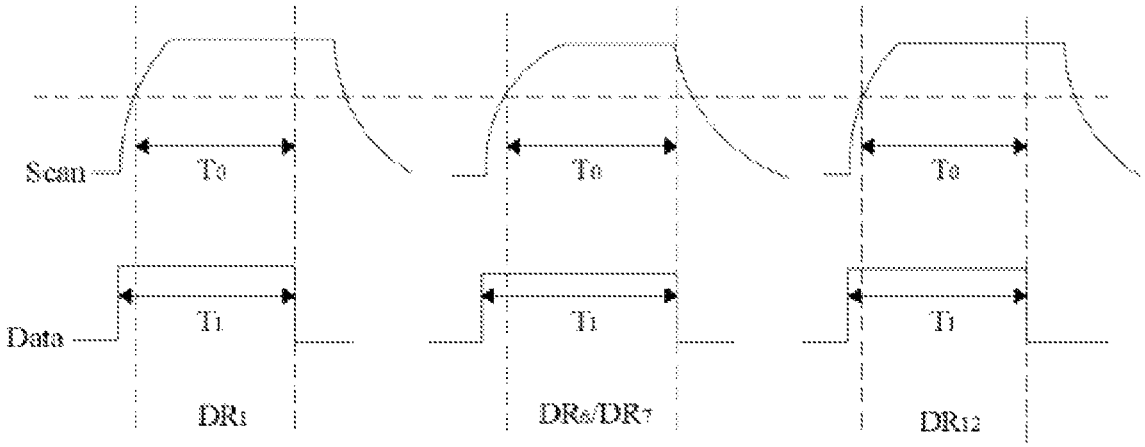
FIG. 5 is a diagram showing a relative timing relationship between scan signals and data signals according to an embodiment of the present disclosure.

As shown in FIG. 5, FIG. 5 is a diagram showing a relative timing relationship between scan signals and data signals according to an embodiment of the present disclosure. In an embodiment, the initial output duration $T_0$ of the source drive circuit 30 is set to 2 μs, the detected average on durations $T_2$ of the switching thin film transistors corresponding to $DR_1$ and $DR_{12}$ are 1.7 μs, and the effective charging durations $T_3$ thereof are 1.5 μs. In this case, it may be obtained that the output duration $T_1$ of $DR_1$ is 1.8 μs. The average on duration $T_2$ of the switching thin film transistor corresponding to $DR_6$ is 1.2 μs, and the effective charging duration T3 thereof is 1.5 μs. It may be obtained that the output duration $T_1$ of $DR_6$ is 2.3 μs. In this way, based on the original initial output duration, the output duration of $DR_1$ can be reduced, and the output duration of $DR_6$ can be increased, so that the sub-pixels corresponding to $DR_1$ and $DR_6$ can reach a target voltage within similar charging times, and the voltage difference between the sub-pixel connected to $DR_1$ and the sub-pixel connected to $DR_6$ is reduced, thereby alleviating the problem of uneven brightness of the display panel.

It should be noted that FIG. 5 only shows a relative timing relationship between scan signals and data signals corresponding to $DR_1$, $DR_6$, and $DR_7$. For the relative timing relationship between scan signals and data signals corresponding to other source drive circuits, reference may be made to is FIG. 5, so the details will not be repeatedly described herein.

An output end of the level setting module 315 is connected to an input end of the storage register 311. The storage register 311 can store the plurality of output adjustment levels and the set value of the output duration corresponding to each output adjustment level that are set by the level setting module 315. During operation of the display panel and the electronic device, the detection module 314 can detect the average on duration of the switching thin film transistors corresponding to the source drive circuit 30, and the level setting module 315 selects the corresponding level according to the average on duration and controls the storage register 311 to output the set value of the output duration corresponding to the level to the clock generator 312.

Figure 6:
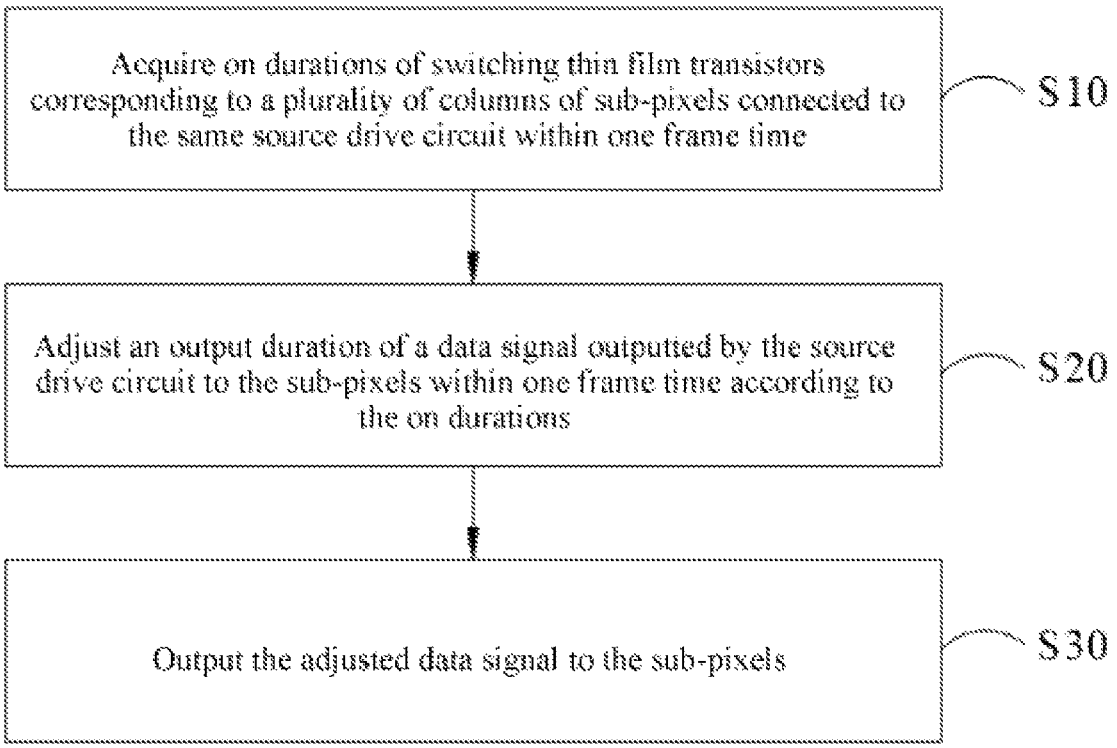
FIG. 6 is a schematic flowchart of a display panel driving method according to an embodiment of the present disclosure.

FIG. 6 is a schematic flowchart of a display panel driving method according to an embodiment of the present disclosure. As shown in FIG. 6, the display panel driving method is used for driving the display panel provided in the above embodiments. The display panel driving method includes:

step S10: acquiring on durations of switching thin film transistors corresponding to a plurality of columns of sub-pixels connected to the same source drive circuit within one frame time;

step S20: adjusting an output duration of a data signal outputted by the source drive circuit to the sub-pixels within one frame time according to the on durations; and step S30: outputting the adjusted data signal to the sub-pixels, wherein a distance between the sub-pixel and a gate drive circuit is positively correlated to the output duration, and a distance between the sub-pixel and the gate drive circuit is negatively correlated to the on duration.

Further, the step of adjusting an output duration of a data signal outputted by the source drive circuit to the sub-pixels within one frame time according to the on durations in step S20 includes:

step S210: acquiring a maximum on duration and a minimum on duration among the on durations;

step S220: obtaining the average on duration of the switching thin film transistors corresponding to the plurality of columns of sub-pixels within one frame time according to the maximum on duration and the minimum on duration; and step S230: obtaining the output duration according to an initial output duration of outputting of the data signal to the sub-pixels by the source drive circuit within one frame time, the effective charging duration, and the average on duration.

Further, the step of obtaining the output duration according to an initial output duration of outputting of the data signal to the sub-pixels by the source drive circuit within one frame time, the effective charging duration, and the average on duration in step S230 includes: obtaining an output compensation duration according to the average on duration and the effective charging duration; obtaining the output duration according to the initial output duration and the output compensation duration.

In an embodiment of the present disclosure, the output compensation duration (output duration adjustment value) in step S230 is a difference between the average on duration and the effective charging duration, and the output duration is a difference between the initial output duration and the output compensation duration.

Further, the display panel driving method further includes: setting a plurality of output adjustment levels and the output duration corresponding to each of the output adjustment levels according to the number of the source drive circuits and the average on duration corresponding to each of the source drive circuits.

In an embodiment of the present disclosure, the output durations of the data signals received by the plurality of columns of sub-pixels connected to the same source drive circuit are equal.

Beneficial effects of the embodiments of the present disclosure are as follows: The embodiments of the present disclosure provide a display panel, a display panel driving method, and an electronic device. The electronic device includes the display panel. The display panel driving method is used for driving the display panel. The display panel includes a display region, a gate drive circuit, and a plurality of source drive circuits. The display region includes sub-pixels distributed in a plurality of rows and a plurality of columns. The gate drive circuit is connected to at least one end of the display region, and the source drive circuits are connected to the S105 display region. Each of the source drive circuits is configured to output a data signal to a corresponding plurality of columns of sub-pixels. The source drive circuits each include a time control unit. The time control unit is configured to control an output duration of the data signal outputted by the source drive circuit to the sub-pixels within one frame time. A distance between the sub-pixel and the gate drive circuit is positively correlated to the output duration. This can reduce the charging time of the sub-pixels close to the gate drive circuit and increase the charging time of the sub-pixels far away from the gate drive circuit, so as to reduce the voltage difference between the sub-pixels close to the gate drive circuit and the sub-pixels far away from the gate drive circuit, thereby solving the problem of uneven brightness of the display panel in the transverse direction.

In conclusion, although the present disclosure is disclosed above with reference to preferred embodiments, the foregoing preferred embodiments are not intended to limit the present disclosure. A person of ordinary skill in the art may make various modifications and embellishments without departing from the spirit and scope of the present disclosure. Therefore, the protection scope of the present disclosure falls within the scope defined by the claims.

What is claimed is:

1. A display panel, comprising:

a display region, comprising sub-pixels distributed in a plurality of rows and a plurality of columns;

a plurality of source drive circuits, connected to the display region, wherein each of the source drive circuits is configured to output a data signal to a corresponding plurality of columns of sub-pixels; and a gate drive circuit, connected to the display region, and configured to output a scan signal to a corresponding plurality of rows of sub-pixels, wherein the source drive circuits each comprise a time control unit, the time control unit is configured to control an output duration of the data signal outputted by the source drive circuit to the sub-pixels within one frame time, and a distance between the sub-pixel and the gate drive circuit is positively correlated to the output duration; and wherein the time control unit further comprises:

a detection module, configured to acquire on durations of switching thin film transistors corresponding to a plurality of columns of sub-pixels connected to the same source drive circuit within one frame time, and obtain an average on duration according to the on durations of the switching thin film transistors; and a level setting module, wherein an input end of the level setting module is connected to an output end of the detection module, and the level setting module is configured to set and select a required output adjustment level according to the number of the source drive circuits and the average on duration.

2. The display panel according to claim 1, wherein the time control unit comprises:

a storage register, configured to store a set value of the output duration;

a clock generator, connected to the storage register, wherein the clock generator is configured to generate a clock signal with a corresponding pulse width according to the set value of the output duration; and a shift register, connected to the clock generator, wherein the shift register is configured to output the data signal with a corresponding pulse width according to the clock signal.

3. The display panel according to claim 1, wherein the obtaining the average on duration according to the on durations of the switching thin film transistors by the detection module further comprises:

acquiring a maximum on duration and a minimum on duration among the on durations; and obtaining the average on duration of the switching thin film transistors corresponding to the plurality of columns of sub-pixels connected to the same source drive circuit within one frame time according to the maximum on duration and the minimum on duration.

4. The display panel according to claim 3, wherein the setting and selecting the required output adjustment level according to the number of the source drive circuits and the average on duration by the level setting module further comprises:

acquiring an effective charging duration required for the sub-pixels to reach a target voltage;

obtaining the output duration according to an initial output duration of outputting of the data signal to the sub-pixels by the source drive circuit within one frame time, the effective charging duration, and the average on duration; and setting a plurality of output adjustment levels and the output duration corresponding to each of the output adjustment levels according to the number of the source drive circuits and the average on duration corresponding to each of the source drive circuits.

5. The display panel according to claim 4, wherein the obtaining the output duration according to an initial output duration of outputting of the data signal to the sub-pixels by the source drive circuit within one frame time, the effective charging duration, and the average on duration further comprises:

obtaining an output compensation duration according to the average on duration and the effective charging duration; and obtaining the output duration according to the initial output duration and the output compensation duration, wherein the output duration adjustment value is a difference between the average on duration and the effective charging duration, and the output duration is a difference between the initial output duration and the output compensation duration.

6. The display panel according to claim 1, wherein the output durations of the data signals received by the plurality of columns of sub-pixels connected to the same source drive circuit are equal.

7. The display panel according to claim 1, wherein the source drive circuit further comprises:

an input register, configured to receive and store display data;

a line latch, respectively connected to the input register and the time control unit, wherein the line latch is configured to latch the display data in the input register;

a digital-to-analog converter, connected to the time control unit, wherein the digital-to-analog converter is configured to convert a digital signal into an analog signal; and an output buffer circuit, connected to the digital-to-analog converter, and configured to output the data signal converted by the digital-to-analog converter to the sub-pixels.

8. The display panel according to claim 2, wherein an output end of the level setting module is connected to an input end of the storage register, and the storage register stores a plurality of output adjustment levels and the set value of the output duration corresponding to one of the output adjustment levels that are set by the level setting module.

9. An electronic device, comprising a display panel, wherein the display panel comprises:

a display region, comprising sub-pixels distributed in a plurality of rows and a plurality of columns;

a plurality of source drive circuits, connected to the display region, wherein each of the source drive circuits is configured to output a data signal to a corresponding plurality of columns of sub-pixels; and a gate drive circuit, connected to the display region, and configured to output a scan signal to a corresponding plurality of rows of sub-pixels, wherein the source drive circuits each comprise a time control unit, the time control unit is configured to control an output duration of the data signal outputted by the source drive circuit to the sub-pixels within one frame time, and a distance between the sub-pixel and the gate drive circuit is positively correlated to the output duration; and wherein the time control unit further comprises:

a detection module, configured to acquire on durations of switching thin film transistors corresponding to a plurality of columns of sub-pixels connected to the same source drive circuit within one frame time, and obtain an average on duration according to the on durations of the switching thin film transistors; and a level setting module, wherein an input end of the level setting module is connected to an output end of the detection module, and the level setting module is configured to set and select a required output adjustment level according to the number of the source drive circuits and the average on duration.

10. The electronic device according to claim 9, wherein the time control unit further comprises:

a storage register, configured to store a set value of the output duration;

a clock generator, connected to the storage register, wherein the clock generator is configured to generate a clock signal with a corresponding pulse width according to the set value of the output duration; and a shift register, connected to the clock generator, wherein the shift register is configured to output the data signal with a corresponding pulse width according to the clock signal.

11. The electronic device according to claim 10, wherein an output end of the level setting module is connected to an input end of the storage register, and the storage register stores a plurality of output adjustment levels and the set value of the output duration corresponding to one of the output adjustment levels that are set by the level setting module.

12. The electronic device according to claim 9, wherein the obtaining the average on duration according to the on durations of the switching thin film transistors by the detection module further comprises:

acquiring a maximum on duration and a minimum on duration among the on durations; and obtaining the average on duration of the switching thin film transistors corresponding to the plurality of columns of sub-pixels connected to the same source drive circuit within one frame time according to the maximum on duration and the minimum on duration.

13. The electronic device according to claim 12, wherein the setting and selecting the required output adjustment level according to the number of the source drive circuits and the average on duration by the level setting module further comprises:

acquiring an effective charging duration required for the sub-pixels to reach a target voltage;

obtaining the output duration according to an initial output duration of outputting of the data signal to the sub-pixels by the source drive circuit within one frame time, the effective charging duration, and the average on duration; and setting a plurality of output adjustment levels and the output duration corresponding to each of the output adjustment levels according to the number of the source drive circuits and the average on duration corresponding to each of the source drive circuits.

14. The electronic device according to claim 13, wherein the obtaining the output duration according to an initial output duration of outputting of the data signal to the sub-pixels by the source drive circuit within one frame time, the effective charging duration, and the average on duration further comprises:

obtaining an output compensation duration according to the average on duration and the effective charging duration; and obtaining the output duration according to the initial output duration and the output compensation duration, wherein the output duration adjustment value is a difference between the average on duration and the effective charging duration, and the output duration is a difference between the initial output duration and the output compensation duration.

15. The electronic device according to claim 9, wherein the output durations of the data signals received by the plurality of columns of sub-pixels connected to the same source drive circuit are equal.

16. A display panel driving method, comprising:

acquiring on durations of switching thin film transistors corresponding to a plurality of columns of sub-pixels connected to the same source drive circuit within one frame time;

adjusting an output duration of a data signal outputted by the source drive circuit to the sub-pixels within one frame time according to the on durations; and outputting the adjusted data signal to the sub-pixels, wherein a distance between the sub-pixel and a gate drive circuit is positively correlated to the output duration, and a distance between the sub-pixel and the gate drive circuit is negatively correlated to the on duration; and wherein the step of adjusting an output duration of a data signal outputted by the source drive circuit to the sub-pixels within one frame time according to the on durations comprises:

acquiring a maximum on duration and a minimum on duration among the on durations;

obtaining the average on duration of the switching thin film transistors corresponding to the plurality of columns of sub-pixels within one frame time according to the maximum on duration and the minimum on duration; and obtaining the output duration according to an initial output duration of outputting of the data signal to the sub-pixels by the source drive circuit within one frame time, the effective charging duration, and the average on duration.

17. The display panel driving method according to claim 16, wherein the step of obtaining the output duration according to an initial output duration of outputting of the data signal to the sub-pixels by the source drive circuit within one frame time, the effective charging duration, and the average on duration comprises:

obtaining an output compensation duration according to the average on duration and the effective charging duration; and obtaining the output duration according to the initial output duration and the output compensation duration, wherein the output duration adjustment value is a difference between the average on duration and the effective charging duration, and the output duration is a difference between the initial output duration and the output compensation duration.

18. The display panel driving method according to claim 16, wherein the display panel driving method further comprises:

setting a plurality of output adjustment levels and the output duration corresponding to each of the output adjustment levels according to the number of the source drive circuits and the average on duration corresponding to each of the source drive circuits.

19. The display panel driving method according to claim 16, wherein the output durations of the data signals received by the plurality of columns of sub-pixels connected to the same source drive circuit are equal.

* * * * *